US008100672B2

(12) United States Patent
Walavalkar et al.

(10) Patent No.: US 8,100,672 B2
(45) Date of Patent: Jan. 24, 2012

(54) AUTONOMOUS ELECTROCHEMICAL ACTUATION OF MICROFLUIDIC CIRCUITS

(75) Inventors: Sameer Walavalkar, Los Angeles, CA (US); Axel Scherer, Laguna Beach, CA (US)

(73) Assignee: California Institute of Technology, Pasadena, CA (US)

( * ) Notice: Subject to any disclaimer, the term of this patent is extended or adjusted under 35 U.S.C. 154(b) by 645 days.

(21) Appl. No.: 12/349,365

(22) Filed: Jan. 6, 2009

(65) Prior Publication Data

US 2009/0260692 A1 Oct. 22, 2009

Related U.S. Application Data

(60) Provisional application No. 61/010,828, filed on Jan. 11, 2008, provisional application No. 61/066,404, filed on Feb. 20, 2008.

(51) Int. Cl.

| | |
|---|---|
| ***F04B 17/00*** | (2006.01) |
| ***F17D 1/16*** | (2006.01) |
| ***F15C 1/04*** | (2006.01) |
| ***B21D 39/03*** | (2006.01) |

(52) U.S. Cl. ..... 417/379; 137/13; 137/827; 137/833; 137/831; 29/428; 29/890.09

(58) Field of Classification Search ..... None
See application file for complete search history.

(56) References Cited

U.S. PATENT DOCUMENTS

| | | | | |
|---|---|---|---|---|
| 5,038,821 | A | 8/1991 | Maget | |
| 7,134,486 | B2 * | 11/2006 | Santiago et al. | 165/104.28 |
| 7,185,697 | B2 * | 3/2007 | Goodson et al. | 165/104.33 |
| 7,334,630 | B2 * | 2/2008 | Goodson et al. | 165/104.33 |
| 2005/0052502 | A1 | 3/2005 | Chung et al. | |
| 2011/0105982 | A1 * | 5/2011 | Leonard et al. | 604/6.01 |

OTHER PUBLICATIONS

M.A. Unger et al., "Monolithic Microfabricated Valves and Pumps by Multilayer Soft Lithography", Science, vol. 288, Apr. 7, 2000, pp. 113-116.

C.R. Neagu et al., "An electrochemical active valve", Electrochimica Acta., vol. 42, Nos. 20-22, pp. 3367-3373, 1997.

J. Xie et al., "Electrolysis-based on-chip dispensing system for ESI-MS", In: Tech. Digest of MEMS 2003, pp. 443-446, Jan. 2003.

J. Park et al., "An Intelligent Dissolved Oxygen Microsensor System with Electrochemically Actuated Fluidics", IEEE Xplore, pp. 170-173, 2004.

PCT Search Report for PCT/US2009/030218 in the name of California Institute of Technology filed on Jan. 6, 2009.

PCT Written Opinion for PCT/US2009/030218 in the name of California Institute of Technology filed on Jan. 6, 2009.

Michel M. Maharbiz, William J. Holtz, Sahar Sharifzadeh, Jay D. Keasling, and Roger T. Howe. "A Microfabricated Electrochemical Oxygen Generator for High-Density Cell Culture Arrays," IEEE, Journal of Microelectrochemical Systems, vol. 12, No. 5, pp. 590-599, Oct. 2003.

* cited by examiner

*Primary Examiner* — Natalie Walford
(74) *Attorney, Agent, or Firm* — Steinfl & Bruno LLP

(57) ABSTRACT

A microfluidic structure with an electrically controlled pressure source is shown. The pressure source is an electrolyte connected with electrodes. Dissociation of the electrolyte generates the pressure, which is used to obtain a valve-like or pump-like behavior inside the microfluidic structure. A process for manufacturing the microfluidic structure and a method to circulate fluids in a microfluidic channel are also described.

20 Claims, 3 Drawing Sheets

AUTONOMOUS ELECTROCHEMICAL ACTUATION OF MICROFLUIDIC CIRCUITS

CROSS REFERENCE TO RELATED APPLICATIONS

The present application claims priority to U.S. Provisional Application No. 61/010,828 for "Electrochemically Actuated Microfluidic Chips made by the Integration of Metalized Substrates with Microfluidic Layers" filed on Jan. 11, 2008, and to U.S. Provisional Application No. 61/066,404 for "Electrochemically Actuated Microfluidic Chips made by the Integration of Metalized Substrates with Microfluidic Layers" filed on Feb. 20, 2008, both of which are incorporated herein by reference in their entirety.

FEDERAL SUPPORT STATEMENT

The U.S. Government has certain rights in this invention pursuant to Grant No. HR0011-04-10054 awarded by DARPA.

FIELD

The present disclosure related to microfluidic chips or circuits. In particular, it relates to electrochemically actuated microfluidic chips, such as those made by the integration of metalized substrates with microfluidic layers.

BACKGROUND

Microfluidics is an expanding field with applications ranging from immunoassays to nuclear magnetic resonance (NMR) of ultra-small volume samples to single cell analysis. The common feature of these applications is a need for the precise control and driving of various solutions. Although microfluidic chips or circuits are relatively cheap and simple to make, the overhead required to control the fluids on the chip is bulky and expensive. Controlling a micro-valve or pump on chip typically requires a corresponding macroscopic solenoid valve or syringe pump as well as external compressed air sources. For simple laboratory work this technological and monetary overhead is manageable, however for microfluidics to transition into the mainstream marketplace a method should be devised to cut the tether between microfluidic chips and their external valves and pressure sources.

Electrochemistry is a field that focuses on using electrical potentials to induce chemical reactions and vice versa. Typically a current is passed through a salt solution inducing non-spontaneous chemical reactions to occur, or the reverse, spontaneous chemical reactions are used to generate voltages. In industry, electrochemistry is used in a variety of processes; to generate voltages in batteries, refine metals, or protect metal structures from corrosion. If the correct electrolyte solution is selected, it is possible for an applied current to decompose the water solvent instead of the chemical salt solutes in a process known as electrolysis. When water is decomposed it liberates its constituent Oxygen and Hydrogen atoms as gas according to the following stoichiometric formula:

$$2H_2O \Rightarrow O_{2(g)} + 2H_{2(g)}$$

This non-spontaneous reaction occurs above a threshold applied voltage of 2.06 V in case of Platinum electrodes in $Na_2SO_4$ solution. Once above the threshold voltage, the amount of gas liberated is directly proportional to the amount of current passed through the solution.

SUMMARY

According to a first aspect, a microfluidic structure is provided, comprising: control layers comprising control channels; fluidic layers comprising microfluidic channels, the microfluidic channels adapted to be controlled by the control channels; and a pressure source comprising an electrolyte adapted to be electrolitically dissociated in one or more fluids, the pressure source fluidically connected with at least one control channel, wherein, upon electrolytic dissociation of the electrolyte, the one or more fluids travel along the at least one control channel to control the microfluidic channels.

According to a second aspect, a process for manufacturing a microfluidic structure containing a pressure source is provided, comprising: forming electrodes; forming microfluidic chambers and microfluidic channels; positioning the electrodes in a microfluidic chamber of the formed microfluidic chambers; locating an electrolyte in the microfluidic chamber, the electrolyte contacting the electrodes and acting as a pressure source upon dissociation of the electrolyte into one or more fluids when current passes through the electrodes; and connecting the microfluidic chamber with at least one microfluidic channel of the microfluidic channels.

According to a third aspect, a method to circulate at least one between oxygen and hydrogen in a microfluidic channel is provided, comprising: locating electrically controlled water inside a chamber of a microfluidic circuit comprising the microfluidic channel; fluidically connecting the chamber with the microfluidic channel; and electrolitically dissociating the water into oxygen and hydrogen, whereby at least one of oxygen and hydrogen circulates in the microfluidic channel.

Further aspects of the present disclosure are shown in the specification, figures and claims of the present application.

DETAILED DESCRIPTION

Applicants have noted that since the microfluidic environment is that of a sealed, fixed volume, generation of gas directly results in generation of on-chip pressure. Therefore it is possible, through electrochemistry, to generate pressure on a chip or circuit and thus actuate key microfluidic elements of the microfluidic chip, such as valves and pumps. An added benefit is the freeing of microfluidic chips from the constraints of external pressure sources, valves, and tubing.

The present disclosure describes several geometries which use this effect within elastomeric materials to actuate valves and create pressure gradients to pump fluids for electrochemically controlling fluidic systems. In particular, use of electrolytic dissociation is described to provide electrical control over on-chip pressure sources within microfluidic chips in order to autonomously actuate valves and pumps without the need for external pressure control systems. Such on-chip generation and control of pressure is expected to lead to autonomous and efficient fluidic systems, entirely controlled with microelectronic control circuitry.

The possible goals for the electrolytic system in accordance with the present disclosure are to eliminate external pressure sources and pneumatic controls, to enable low-power electronic actuation with low-voltage batteries, to retain the ability to generate pressure gradients on the chip, and to be compatible with lithographic microfabrication and soft lithography techniques.

A further possible consequence of the methods and systems according to the present disclosure is to deliberately generate and measure oxygen and hydrogen, with important implications in the control over biological systems and cell cultures that can be maintained on the chips.

The voltages and currents required to control are modest and are of the CMOS levels and therefore large numbers of these devices may be integrated onto a chip. Moreover, using standard photolithography (features reliably fabricated as small as 5 microns) the metallization layer can be fabricated to fit within the confines of standard microfluidic valves.

Applicants describe, in some examples of the present disclosure, push-down type valves and simple syringe pumps that can be combined just as standard microfluidic valves and pumps in manifolds such as multiplexing systems. The similar structure of standard elastomeric push-down valves is maintained, utilizing the large amounts of pressure generated to induce distension of membranes between two microfluidic layers.

Figure 1:
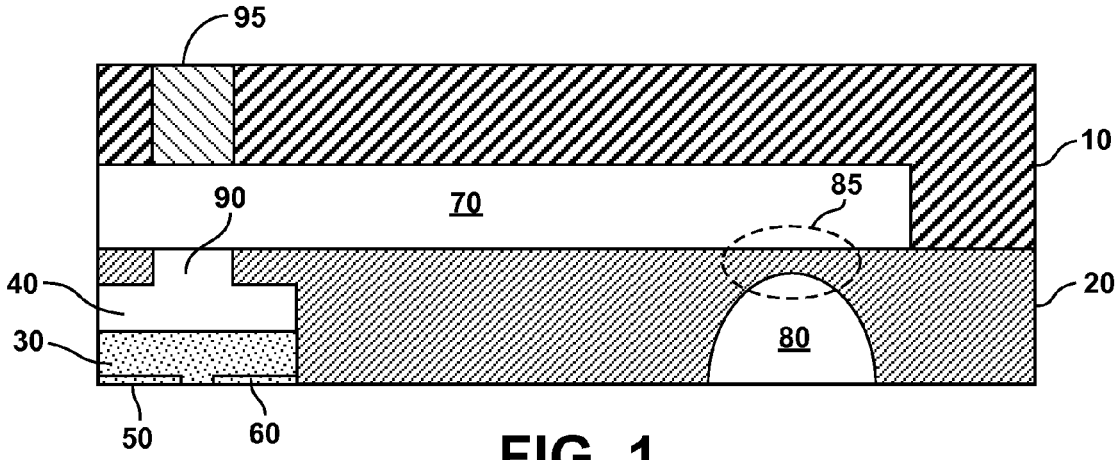
FIG. 1 shows a schematic cross sectional view of a microfluidic valve structure in accordance with the present disclosure.

FIG. 1 shows a schematic cross sectional view of a microfluidic push-down valve structure in accordance with the present disclosure. A control layer (10) is located above a fluidic layer (20). An electrolyte (30) is located in a chamber (40). The chamber (40) is positioned, for example, in the fluidic layer (20). Metal electrodes (50), (60) are in contact with the electrolyte (30). By way of example and not of limitation, the electrodes can be made of Platinum or some other Noble metal such as Gold. FIG. 1 also shows a control channel (70) located in the control layer (10) and a fluid channel (80) located in the fluidic layer (20). Chamber (40) and control channel (70) are fluidically connected along a fluid contact region (90). Region (85) between control channel (70) and fluid channel (80) represents a membrane region which is adapted to distend in order to shut off the fluid channel (80). A seal (95) is also shown. Seal (95) seals the original microfluid insertion holes in order to provide a leak-free cavity. For example, a wax can be used that is solid at room temperature but liquid at about 90° C. Such wax can be dripped onto the insertion holes and let harden. Alternatively, liquid PDMS or a sticky polymer can be used.

Figure 2:
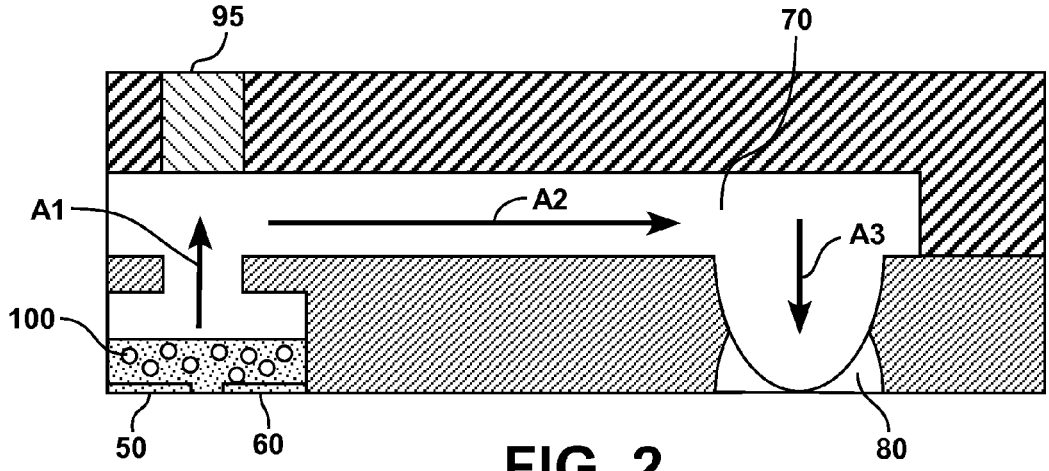
FIG. 2 shows a schematic cross sectional view of pressure buildup due to decomposition of water in accordance with the present disclosure.

FIG. 2 shows a schematic cross sectional view of the valve during its operation, where pressure buildup due to decomposition of water occurs.

Gas (100) generated at the electrodes (50), (60) exits chamber (40) along direction (A1) and traverses the length of control channel (70) along direction (A2). Pressure buildup of the gas along control channel (70) results in the downward distension of the control channel (70) along direction (A3), preventing the flow of fluid in the lower fluid channel (80). The valve re-opens once the current passing through electrodes (50), (60) is shut off and the pressurized gas diffuses out of the elastomer of which the control layer (10) and the fluidic layer (20) are made.

It should be noted that the hydrogen and oxygen generated while applying a current through the electrochemical cell shown in FIGS. 1-2 produces a significant pressure if confined within the small chambers and channels on typical microfluidic chips. An example of calculation of the pressure generated will now be discussed. In the galvanic generation, 3 mols of gas are generated from 2 mols of water. From the ideal gas law, it can be noted that $7.5\times10^{9}$ mols of gas per second (or $1.84\times10^{-7}$ l/s) are generated with 1 mA of applied current. In a microfluidic valve arrangement having a volume of $4\times10^{-8}$ l, a pressure of 70 psi/s at 1 mA can be calculated. Polymethylsilicone (PDMS) flow valves typically close when 15 psi is applied. Therefore, the valve is expected to close within 0.2 s. To re-open the valve, the pressure differential should be equilibrated. This can be accomplished by either applying pressure to the channel (80) of FIGS. 1-2 with another electrochemical cell or by reversing the current flowing through electrodes (50), (60) of FIGS. 1-2.

Figure 3:
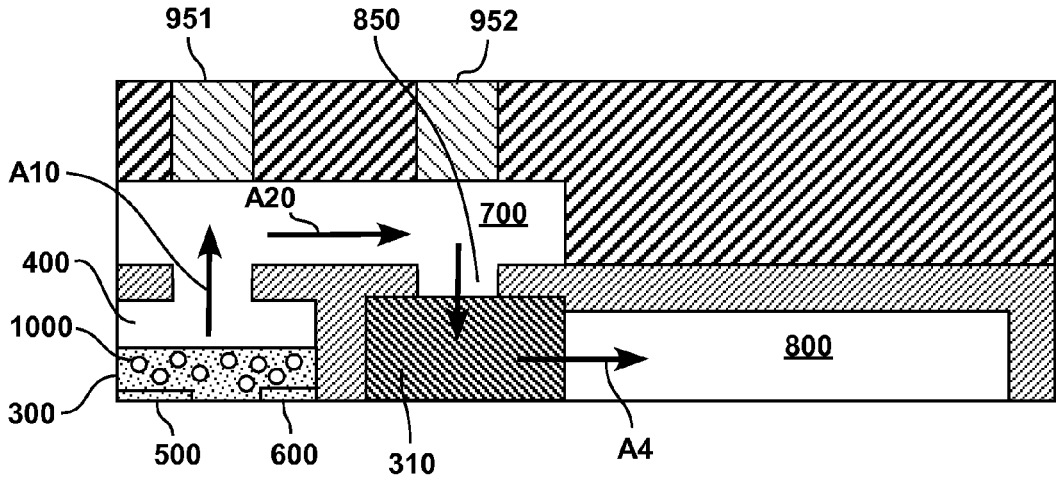
FIG. 3 shows a schematic cross sectional view of a further arrangement of the present disclosure, where pressure generated in a first pressure vessel presses down on a fluid stored in a second pressure vessel.

FIG. 3 shows a schematic cross sectional view of a further arrangement of the present disclosure, where pressure generated in a first pressure vessel or pressure pot presses down on a fluid stored in a second pressure vessel or pressure pot. In other words, FIG. 3 shows a "pump" embodiment of the present disclosure, differently from the "valve" embodiment shown in FIG. 2 above.

In particular, according to the embodiment of FIG. 3, the gas pressure generated is used to push the fluid instead of distending a membrane.

As shown in FIG. 3, and differently from what shown in the previous figures, a control layer (700) is in fluidic contact with a fluidic layer (800) along a fluid contact region (850). Moreover, instead of a single fluid (30), two separate fluids are shown in FIG. 3. Fluid (300) is substantially identical, in structure and function, to fluid (30) shown in the previous figures. However, an additional fluid (310) is located in the fluidic layer (800) and is adapted to generate pressure along the fluidic layer (800) upon current generation in the electrodes (500), (600). In particular, gas (1000) generated at the electrodes (500), (600) exits chamber (400) along direction (A10) and traverses the length of control channel (700) along direction (A20). Pressure buildup of the gas along control channel (700) results in pressure exercised on the additional fluid (310) along the fluid contact region (850), thus causing the additional fluid (310) to move along direction A4 of fluidic channel (800) and exercise pump pressure along such channel. Also shown in FIG. 3 are seals (951), (952).

Bi-directionality of such embodiment can be achieved with this pump by simply putting the mirror image of the same structure shown in FIG. 3 on the other end of the fluidic channel (800).

Therefore, while the embodiment of FIGS. 1 and 2 can be used for the actuation of valves, such as pneumatic valves, the embodiment of FIG. 3 can be used for the actuation of pumps.

The small geometries available by using microfluidic channels enable very high pressures to be generated within short amounts of time, and make on-chip pressure sources very attractive to pushing liquids through narrow fluid channels where the flow rates are limited by the low Reynolds number and large surface-to-volume ratios. In the electrochemical pressure source in accordance with the present disclosure, the precise pressure can be controlled electrically and even reversed by changing the direction of current flow applied to the electrodes.

In particular, both peristaltic and syringe pumps can be realized with the teachings of the present disclosure. For example, in a peristaltic pump, three valves can be sequentially actuated within a channel. The performance is determined by the speed of valve actuation. In a syringe pump, the teachings of the present disclosure enable solution to be pushed over functionalized surfaces in the microfluidic channels many times, thereby improving, for example, a binding efficiency between an antibody and an antigen. Integrated microfluidic chips can also be designed to combine electrolytic dissociation for locally generating pressure and to open/close valves with electrophoretic flow to move conductive solutions from place to place on the fluidic chip.

Figure 4:
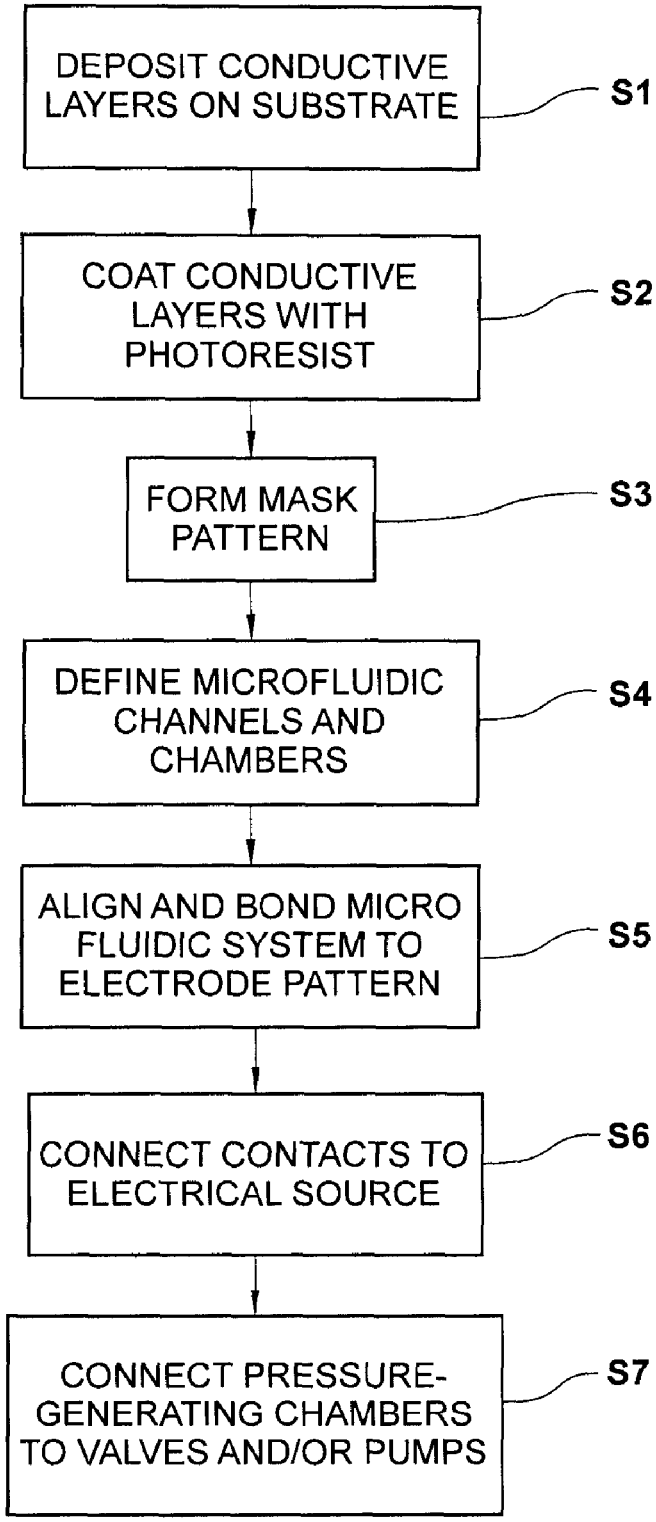
FIG. 4 is a flow chart describing a method to manufacture pressure chambers in accordance with the present disclosure.

A method to define the electrochemical portion of the structure shown in FIGS. 1-3 will now be described with reference to FIG. 4.

Conductive layers (e.g., 100 nm platinum layers) are deposited onto a substrate (e.g., a glass substrate), see step (S1). Such deposition can occur, for example, by using a DC magnetron sputter deposition system. The layers are subsequently coated with photoresist (S2) and exposed with a mask pattern to leave photoresist mask patterns over the electrodes for the electrochemical cells (S3). Selective removal of photoresist to form patterns can occur by way of a photoresist developer, e.g., Transene® MF-319. On the other hand, photoresist can be cleaned off, for example, in acetone. Unprotected platinum can be removed, for example, through argon ion milling. Microfluidic channels and chambers are then defined (S4). Definition can occur, for example, through replication molding in PDMS elastomer from photoresist coated silicon dies. The microfluidic system is then aligned to the electrode patterns on the substrate and bonded (S5). The electrical contacts are connected (S6) to an electrical source to drive the electrochemical system. Sodium sulphate ($Na_2SO_4$) can be used as an electrolyte to ensure high conductivity in the pressure generating cells or chambers. The pressure generating cells or chambers are in turn connected (S7) to push-down pneumatic valves (see, e.g., FIGS. 1-2) and/or pumps (see, e.g., FIG. 3) that control fluids on the chip.

Generation and measurement of Oxygen and Hydrogen in accordance with the teachings of the present disclosure will now be described.

In accordance with the teachings according to the present disclosure, electrochemical dissociation of water into oxygen and hydrogen can be obtained and rapidly adjusted within very small volumes. This enables the development of cell culturing systems and enables the probing of metabolic pathways. In accordance with an embodiment of the present disclosure, instead of need for external gas sources or complex fluids for oxygenation of solutions, the oxygen and hydrogen can be generated on-chip, in or next to the tissue culturing reactor. In accordance with a further embodiment of the present disclosure, it is possible to change the pH of a reaction through the controlled introduction of hydrogen. For example, to control and separate hydrogen and oxygen generation, a salt bridge can be constructed on the chip, ensuring separate fluidic delivery systems for oxygen and hydrogen. A salt bridge as such is well known to the person skilled in the art and will not be here described in detail.

In previous experiments (see, e.g., M. M. Maharbiz, W. J. Holtz, S. Sharifzadeh, J. D. Keasling, R. T. Howe, "A Microfabricated Electrochemical Oxygen Generator for High-Density Cell Culture Arrays," J MicroElectroMechanical Sys, vol. 12, no. 5, pp. 590-599, October 2003), surface forces have been used to directly inject electrolitically generated oxygen bubbles into growth chambers to sustain bacterial growth. However, the oxygen bubbles were separated by the sodium sulphate that was used as the electrolyte to ensure sufficient electro-dissociation. The contamination and unnecessary loss of electrolyte can be avoided if oxygen and hydrogen are generated separately within reactors and routed through microfluidic channels to, e.g., the bacterial growth medium.

Figure 5:
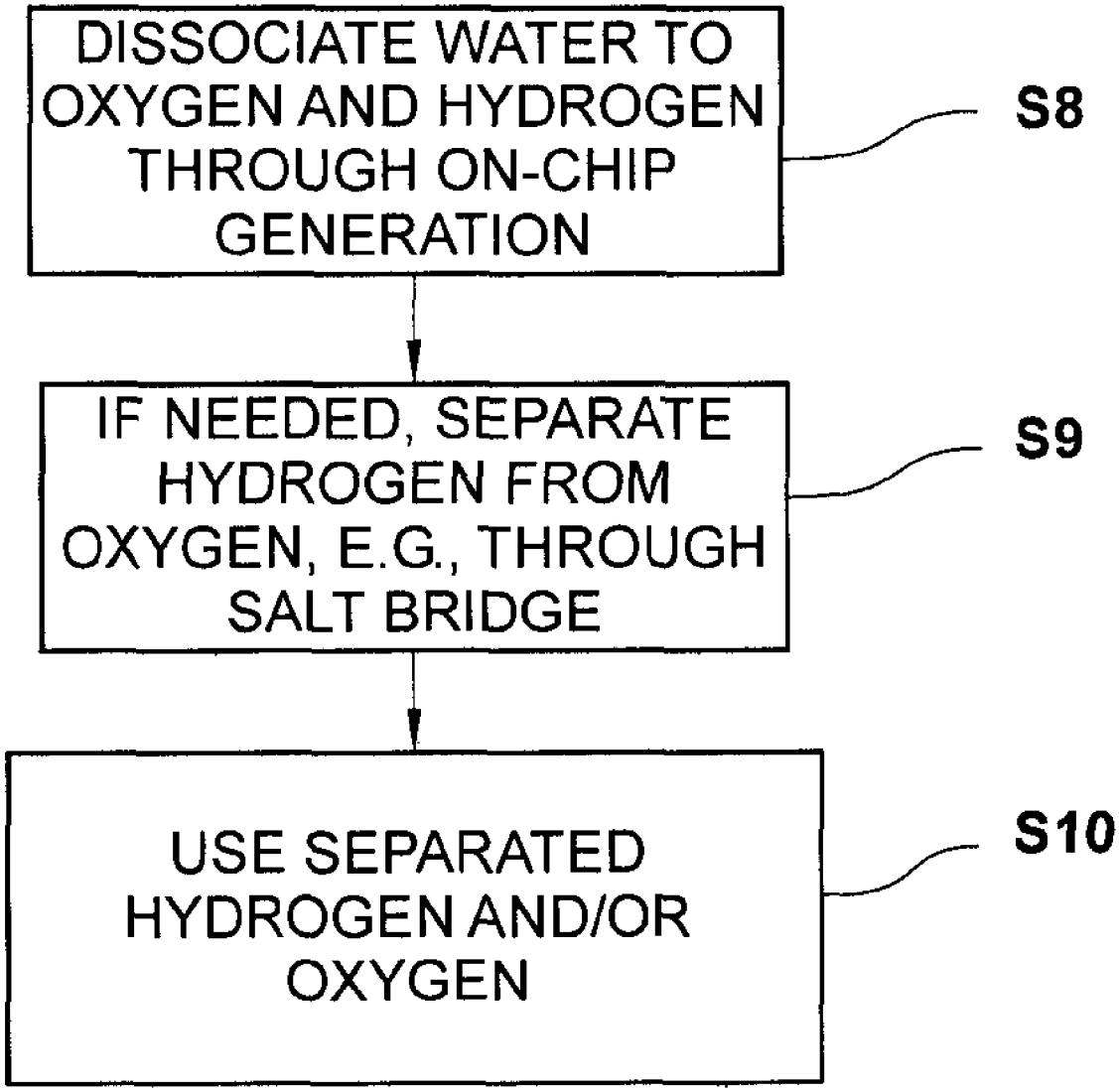
FIG. 5 is a flow chart describing a method of dissociating water in accordance with the present disclosure.

The flow chart shown in FIG. 5 briefly summarizes the embodiments discussed above. Water is dissociated to oxygen and hydrogen through on-chip generation (S8). If needed, hydrogen is separated from oxygen (S9) and separately used (S10).

The person skilled in the art will also understand, upon reading of the teachings of the present disclosure, that once electrodes (e.g., platinum electrodes) have been defined on a chip within microfluidic systems and electrochemical cells are established, these can be used for many other applications.

As described above, methods and devices of making low-cost microfluidic pressure sources, pumps, and valves have been shown, that can be directly actuated on-chip through the application of small amounts of electrical current.

In summary, with the recent development of on-chip valves, it is now possible to address one of the most significant challenges facing modern microfluidic systems. The problem is that the interface between the control systems and the microfluidic system requires expensive components and requires operator intervention. Consequently, microfluidic chips may be very inexpensive, but the "chip readers" for microfluidic systems are very difficult and costly to connect with these micro-plumbing systems. The teachings of the present disclosure overcome such problem by showing the opportunity of electronic on-chip valve and pump control as well as the combination of electrolytic measurement with electrochemical actuation. As shown by the low-power electrolytic pressure sources of the present disclosure, it is possible to directly integrate electronic control signals into complex microfluidic systems. Moreover, the electrical "wiring" of the fluidic systems enables electrophoretic control as well as the measurement and regulation of local temperatures through resistive heaters and platinum resistor thermometers. Local control over the oxygen and hydrogen concentration within these fluidic systems can also enable the control over pH and oxygen concentration so important for cell and bacterial cultures.

The entire disclosure of each document cited (including patents, patent applications, journal articles, abstracts, laboratory manuals, books, or other disclosures) in the present disclosure is hereby incorporated herein by reference.

It is to be understood that the disclosure is not limited to particular methods and devices, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

The invention claimed:

1. A microfluidic structure comprising:

control layers comprising control channels;

fluidic layers comprising microfluidic channels, the microfluidic channels adapted to be controlled by the control channels; and a pressure source comprising an electrolyte adapted to be electrolitically dissociated in one or more fluids, the pressure source fluidically connected with at least one control channel, wherein, upon electrolytic dissociation of the electrolyte, the one or more fluids travel along the at least one control channel to control the microfluidic channels.

2. The microfluidic structure of claim 1, wherein the pressure source further comprises electrodes connected with the electrolyte, dissociation of the electrolyte in the one or more fluids occurring upon generation of current in the electrodes.

3. The microfluidic structure of claim 1, wherein the one or more fluids are gases.

4. The microfluidic structure of claim 1, wherein the electrolyte is water and the one or more fluids are oxygen and hydrogen.

5. The microfluidic structure of claim 1, wherein the electrolyte is sodium sulfate and the one or more fluids are oxygen.

6. The microfluidic structure of claim 1, wherein control of the microfluidic channels by the one or more fluids travelling along the at least one control channel occurs through movement of membrane regions separating the control channels from the microfluidic channels.

7. The microfluidic structure of claim 1, wherein the pressure source is located in a chamber fluidically connected with the at least one control channel.

8. The microfluidic structure of claim 1, further comprising:

a further pressure source comprising a further fluid wherein, upon the electrolytic dissociation of the electrolyte, the one or more fluids exercise pressure on the further fluid which, in turn, generates a pumping effect on the microfluidic channels.

9. The microfluidic structure of claim 8, wherein the further pressure source is located in a microfluidic channel, the microfluidic channel fluidically connected with the control channel in which the one or more fluids are adapted to travel upon the electrolytic dissociation of the electrolyte.

10. The microfluidic structure of claim 8, further comprising a mirror pressure source and a further mirror pressure source, the combination of the pressure source, further pressure source, mirror pressure source and further mirror pressure source adapted to provide the microfluidic structure with a bidirectional pumping effect.

11. A process for manufacturing a microfluidic structure containing a pressure source, comprising:

forming electrodes;

forming microfluidic chambers and microfluidic channels;

positioning the electrodes in a microfluidic chamber of the formed microfluidic chambers;

locating an electrolyte in the microfluidic chamber, the electrolyte contacting the electrodes and acting as a pressure source upon dissociation of the electrolyte into one or more fluids when current passes through the electrodes; and connecting the microfluidic chamber with at least one microfluidic channel of the microfluidic channels.

12. The process of claim 11, wherein the microfluidic chamber is connected with the at least one microfluidic chamber of the microfluidic chambers in a valve arrangement.

13. The process of claim 11, wherein the microfluidic chamber is connected with the at least one microfluidic chamber of the microfluidic chambers in a pumping arrangement.

14. A method to circulate at least one between oxygen and hydrogen in a microfluidic channel, comprising:

locating electrically controlled water inside a chamber of a microfluidic circuit comprising the microfluidic channel;

fluidically connecting the chamber with the microfluidic channel; and electrolitically dissociating the water into oxygen and hydrogen, whereby at least one of oxygen and hydrogen circulates in the microfluidic channel.

15. The method of claim 14, wherein hydrogen is separated from oxygen.

16. The method of claim 15, wherein the at least one of hydrogen and oxygen circulating in the microfluidic channel is hydrogen.

17. The method of claim 14, wherein the electrically controlled water comprises electrodes contacting the water.

18. The method of claim 14, wherein the at least one of oxygen and hydrogen circulates in the microfluidic channel to control fluid circulation.

19. The method of claim 18, wherein control occurs in a valve-like behavior.

20. The method of claim 18, wherein control occurs in a pump-like behavior.

* * * * *